US007923664B2

(12) United States Patent
Kruempelmann et al.

(10) Patent No.: US 7,923,664 B2
(45) Date of Patent: Apr. 12, 2011

(54) METHOD FOR CONTROLLING A COOKING PROCESS IN A COOKING APPLIANCE

(75) Inventors: Thomas Kruempelmann, Guetersloh (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 859 days.

(21) Appl. No.: 11/665,552

(22) PCT Filed: Oct. 14, 2005

(86) PCT No.: PCT/EP2005/011080

§ 371 (c)(1),
(2), (4) Date: Apr. 16, 2007

(87) PCT Pub. No.: WO2006/042708

PCT Pub. Date: Apr. 27, 2006

(65) Prior Publication Data

US 2007/0289962 A1 Dec. 20, 2007

(30) Foreign Application Priority Data

Oct. 14, 2004 (DE) ..... 10 2004 049 927

(51) Int. Cl.
*H05B 3/68* (2006.01)
*H05B 1/02* (2006.01)

(52) U.S. Cl. ..... 219/490; 219/489; 219/492; 99/325; 165/200

(58) Field of Classification Search ..... 219/482, 219/490, 492, 497, 704, 705, 707; 99/325; 165/200

See application file for complete search history.

(56) References Cited

U.S. PATENT DOCUMENTS

| | | | | |
|---|---|---|---|---|
| 4,097,707 | A * | 6/1978 | Kobayashi et al. | 219/707 |
| 4,281,022 | A | 7/1981 | Buck | |
| 4,311,895 | A * | 1/1982 | Tanabe | 219/707 |
| 4,379,964 | A * | 4/1983 | Kanazawa et al. | 219/492 |
| 4,484,065 | A * | 11/1984 | Ueda | 219/492 |
| 4,590,350 | A * | 5/1986 | Ueda | 219/705 |
| 4,734,554 | A * | 3/1988 | Tateda et al. | 219/705 |
| 4,864,088 | A * | 9/1989 | Hiejima et al. | 219/707 |
| 5,349,163 | A * | 9/1994 | An | 219/492 |
| 5,681,496 | A | 10/1997 | Brownlow et al. | |
| 2003/0189040 | A1 * | 10/2003 | Lee et al. | 219/707 |

FOREIGN PATENT DOCUMENTS

| | | |
|---|---|---|
| DE | 196 09 116 | 9/1997 |
| DE | 103 00 465 | 7/2004 |
| EP | 0 074 764 | 3/1983 |
| EP | 1 382 260 | 1/2004 |

* cited by examiner

*Primary Examiner* — Tu B Hoang
*Assistant Examiner* — Brian Jennison
(74) *Attorney, Agent, or Firm* — Leydig, Voit & Mayer, Ltd.

(57) ABSTRACT

A method for controlling a cooking process in a cooking appliance includes determining, from a gas concentration detected during the cooking process, a set of function values corresponding to a shape of a function that depends on the gas concentration from a starting time $t_0$ to a current time $t_n$ during a cooking process. Respective sets of comparison values for a comparison at the time $t_n$ are determined from the sets of reference values. A plurality of the sets of comparison values coming closest to the set of function values is automatically selected, and a set of parameters including at least an ending time of the cooking process is generated. The selected set of parameters is used for an electrical controller of the cooking appliance until a next comparison is made at a time $t_{n+1}$. The method is automatically stopped as soon as the ending time of the cooking process has been reached.

11 Claims, 4 Drawing Sheets

METHOD FOR CONTROLLING A COOKING PROCESS IN A COOKING APPLIANCE

CROSS REFERENCE TO PRIOR APPLICATION

This is a U.S. national phase application under 35 U.S.C. §371 of International Patent Application No. PCT/EP2005/011080, filed Oct. 14, 2005, and claims benefit of German Patent Application No. 10 2004 049 927.6, filed Oct. 14, 2004, which is incorporated by reference herein. The International Application was published in German on Apr. 27, 2006 as WO 2006/042708 A1 under PCT Article 21(2).

The present invention relates to a method for controlling a cooking process in a cooking appliance.

BACKGROUND

An example of a method for controlling a cooking process in a cooking appliance is described in EP 0 074 764 B1. The known method can be used for different types of food to be cooked. In order to infer the type of food to be cooked at this moment in time, the output signal of a gas sensor located in the cooking chamber is evaluated in an electrical controller of the cooking appliance at two different points in time at the beginning of the cooking process, the type of food to be cooked being dete mined from the quotient of the two sensor output signals. The cooking process is stopped as soon as the sensor output signal reaches a value which depends on the type of food to be cooked.

German Patent Application DE 103 00 465 A1 describes a method for controlling a cooking process in a cooking appliance which is provided with a sensor for this purpose. Said sensor is in the form of a humidity sensor and is in signal communication with an electrical controller of the cooking appliance. The electrical controller includes a memory and an evaluation circuit, the memory having stored therein a multiplicity of sets of reference values, which each have associated therewith sets of parameters for the electrical controller. In the known method, the evaluation circuit generates from the gas concentration detected during the cooking process a set of values which corresponds to the shape of a function that depends on the gas concentration from a starting time $t_0$ to a current time $t_n$ during the cooking process. The evaluation circuit generates from the sets of reference values respective sets of comparison values for the comparison at the time $t_n$; the multiplicity of sets of comparison values being compared to the set of values. The set of comparison values which comes closest to the set of values is automatically selected by the evaluation circuit, and the set of parameters associated with this set of comparison values is transformed to the time $t_n$ by means of an algorithm. The cooking process is controlled by the electrical controller in this manner until the ending time of the cooking process is reached.

Another method is described in EP 1 382 260 A2, in which a cooking appliance, especially one for baking, is controlled according to the output signal of a gas sensor. To this end, sets of reference values associated with individual baking mixtures are stored in a memory of the appliance controller. Using an input device, the user selects one of the stored baking mixtures, and thereby a set of reference values whose associated parameters are used by the controller for the cooking process. If, during the cooking process controlled in this manner, deviations occur between the values detected by the sensor and the reference values, the baking process is changed or stopped.

U.S. Pat. No. 5,681,496 A describes another method for controlling a cooking process, in which a humidity sensor is used. Here, too, similar to the method described in DE 103 00 465 A1, the comparison between a set of measured values and a multiplicity of stored sets of comparison values is made only once. The parameters determined in this way are set for the further cooking process which, after the comparison, is controlled independently of subsequent changes in the humidity level in the cooking chamber.

Finally, U.S. Pat. No. 5,349,163 A describes a method for controlling a cooking process, in which a carbon dioxide sensor is used. The further course of the cooking process is determined according to the change in the carbon dioxide concentration during the cooking process.

SUMMARY

In view of the above, it is an aspect of the present invention to provide a method for controlling a cooking process, which can also be used for a multiplicity of foods which are very similar in nature but have different cooking times.

In an embodiment, the present invention provides a method for controlling a cooking process in a cooking appliance, the cooking appliance including a cooking chamber, at least one sensor for detecting a gas concentration in the cooking chamber, and an electrical controller having an evaluation circuit with a timer and a memory and being in signal communication with the sensor, the memory having stored therein a plurality of sets of reference values, each of the sets of reference values corresponding to a respective shape of a reference function from a starting time $t_0$ to a respective ending time $t_Z$ of a reference cooking process, respective sets of parameters for the electrical controller being associated with the sets of reference values. The method includes the steps:

a) determining, in the evaluation circuit, from a gas concentration detected during the cooking process, a set of function values corresponding to a shape of a function that depends on the gas concentration from a starting time $t_0$ to a current time $t_n$ during a cooking process;

b) generating, in the evaluation circuit, from the sets of reference values, respective sets of comparison values for a comparison at the time $t_n$;

c) comparing, in the evaluation circuit, the set of function values to the respective sets of comparison values;

d) automatically selecting, using the evaluation circuit, a plurality of the sets of comparison values coming closest to the set of function values, and generating, using an algorithm, from the respective sets of parameters associated with the respective sets of reference values associated with the selected sets of comparison values, a selected set of parameters including at least an ending time of the cooking process, and using the selected set of parameters for the electrical controller until a next comparison is made at a time $t_{n+1}$; and e) automatically stopping performing of steps a)-d) as soon as the ending time of the cooking process has been reached.

BRIEF DESCRIPTION OF THE DRAWINGS

Exemplary embodiments of the present invention are shown in the drawings in a schematic way and will be described in more detail below. In the drawing.

DETAILED DESCRIPTION

Figure 1:
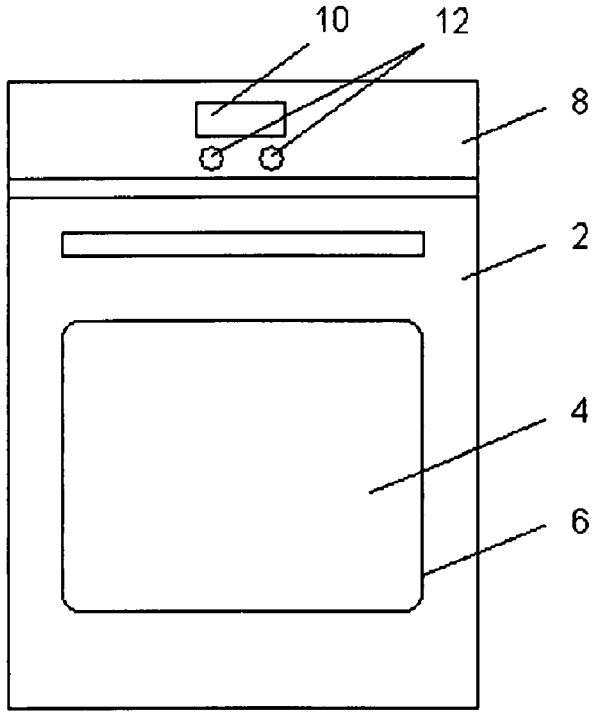
FIG. 1 is a front view of a cooking appliance having a cooking chamber.

A particular advantage made possible by the present invention is that a method for controlling a cooking process is provided which can be used for a multiplicity of foods which are very similar in nature but have different cooking times.

U.S. Pat. No. 4,281,022 in fact describes a method for controlling a cooking appliance, in which the ending time of the cooking process is determined by a comparison between a set of values which is dependent on the output signals of a humidity sensor disposed in a cooking chamber and a set of reference values stored in a memory of an electrical controller. Since the course of a current cooking process is affected by ambient conditions, the known method proposes to estimate the ending time of the current cooking process using the above-mentioned procedure. In contrast to the present invention, the known method can only be used for one type of food, namely a thin piece of meat.

Further, German Patent Application DE 196 09 116 A1 describes a method in which, in order to determine the ending time of the cooking process, the variation with time of the core temperature in a larger piece of meat, which is determined during a current cooking process, is compared to temperature profiles stored in a memory of an electrical controller.

In an advantageous embodiment of the method of the present invention, the similarity of a set of comparison values and the associated ending time $t_Z$ to the set of values is determined in the comparison according to the difference between the time $t_n$ and the respective ending time $t_Z$. This improves the quality in the selection of the sets of comparison values with the greatest similarity, because it can be assumed that the greater the distance between the ending time $t_Z$ of the respective set of comparison values or reference values and the current time $t_n$, the more decreases the similarity between the set of comparison values and the current set of values.

In an advantageous refinement, the sensor detects at least the concentration of carbon dioxide, and the set of values generated in the evaluation circuit corresponds to the variation with time of the carbon dioxide concentration. Carbon dioxide is produced, for example, in each baking process.

In another advantageous refinement, the sensor detects at least the concentration of oxygen, and the set of values generated in the evaluation circuit corresponds to the shape of the first derivative of the oxygen concentration with respect to time. In each cooking process, the oxygen concentration is changed by the vapors in a characteristic way.

In yet another advantageous embodiment, the sensor detects at least the concentration of an oxidizable gas. This allows the use of inexpensive semiconductor sensors.

In an advantageous refinement of the teaching of the present invention, the sensor detects the concentrations of at least two different gases, and each set of reference values stored in the memory includes a number of subsets of values equal to the number of gases that have been detected. This improves the quality of the results obtained in the comparisons according to the present invention. The discrimination between similar and dissimilar sets of comparison values in the comparison to the set of values is enhanced by using not only one gas and its concentration, but a plurality of gases and concentrations for the comparison. Consequently, the comparison is multidimensional and includes a number of sub-comparisons equal to the number of gases or gas concentrations that are detected and for which data are stored in each set of reference values.

The predetermined response of the electrical controller to the comparison can, in principle, be selected within wide suitable limits in terms of type and scope. Advantageously, the generated set of parameters is used to cause the remaining cooking time to be displayed on a display of the cooking appliance and/or to cause a heating source for heating the cooking chamber to be automatically switched off and/or to trigger an audible end-of-cooking signal.

In a particularly advantageous refinement of the teaching of the present invention, the generated set of parameters is used to determine the type of food in current the cooking process, and to select and/or display the mode of operation and the cooking chamber temperature for the cooking process. This allows for a substantially automated cooking process.

In another advantageous embodiment, the output signal of the sensor is processed in the evaluation circuit only after a predetermined time delay has elapsed after the starting time $t_0$. In this manner, the quality of the comparison is further improved because the set of values for the comparison is larger and therefore more meaningful after a delay time has elapsed.

In principle, the set of values can be compared at any time $t_n$ to all sets of comparison values generated from the stored sets of reference values. Advantageously, a subset of the multiplicity of sets of comparison values is preselected for the next comparison at the time $t_n$, said preselection being made according to an input via a control element of the cooking appliance, or according to a preliminary comparison between the set of values and the multiplicity of sets of comparison values made by the evaluation circuit at a predetermined time $t_1$, with $t_1$ being greater than to and smaller than $t_n$.

FIG. 1 shows a cooking appliance in the form of a baking oven. The cooking appliance includes a cooking chamber 4 which is closable by a door 2 and includes a window 6 and a control panel 8, said control panel 8 being provided with a display 10 and two control knobs 12.

Figure 2:
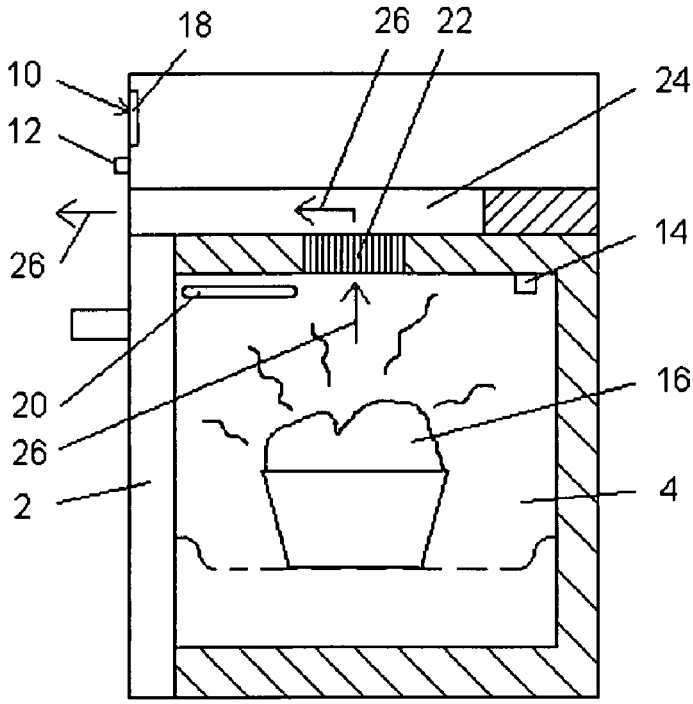
FIG. 2 is a partially cross-sectional side view of the cooking appliance of FIG. 1.

FIG. 2 shows the cooking appliance of FIG. 1 in a partially cross-sectional side view. Cooking chamber 4 has mounted therein a sensor 14 which is in the form of a carbon dioxide sensor and used for detecting the carbon dioxide concentration in cooking chamber 4. A food 16 placed on a food-supporting member is inserted in the cooking chamber. The cooking appliance further has an electrical controller 18 which includes an evaluation circuit with a timer and a memory and is in signal communication with carbon dioxide sensor 14 and a heating source 20 in the form of a resistance heater for heating cooking chamber 4.

When the cooking appliance is in operation, the vapors are removed from cooking chamber 4 through a catalyst 22 and a vapor duct 24 in a manner known to those skilled in the art. This is symbolized in FIG. 2 by arrows 26. Thus, sensor 14 detects an instantaneous gas concentration, since the gases formed during the cooking process are continuously removed from cooking chamber 4. These gases do not concentrate in cooking chamber 4.

The method according to the present invention is not limited to cooking appliances having a catalyst 22, but rather, the cooking appliance optionally may or may not be equipped with a catalyst 22, said catalyst 22 being mounted at or in vapor duct 24 in a manner known to those skilled in the art.

Figure 3:
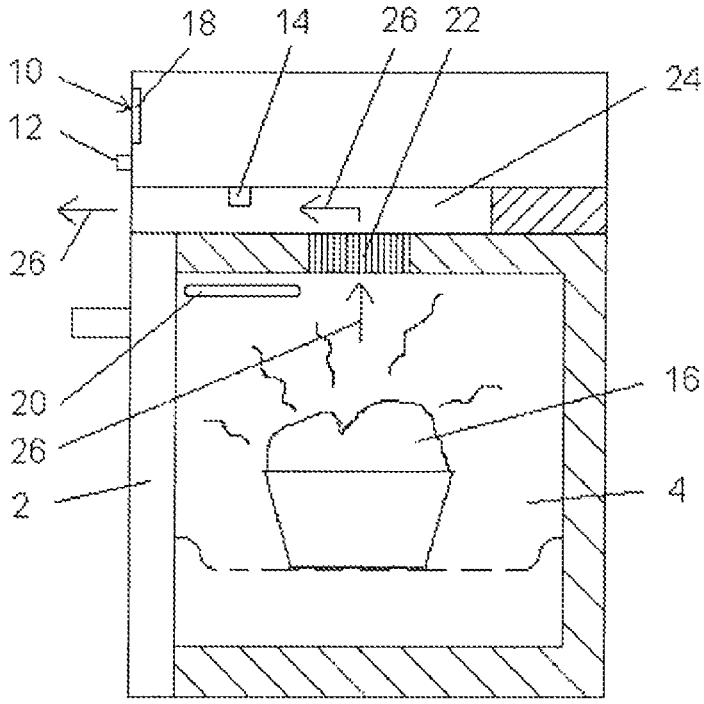
FIG. 3 is a side view analogous to that of FIG. 2, showing another cooking appliance.

Other gas concentrations known to those skilled in the art and suitable for the method of the present invention, such as the oxygen concentration, may also be used as an alternative to the carbon dioxide concentration. If the cooking appliance is provided with a catalyst 22, as explained earlier for the present exemplary embodiment, then it is advantageous to mount sensor 14, which is in the form of an oxygen sensor, downstream of catalyst 22 in the direction of flow because the output signal of sensor 14, which is transmitted to the evaluation circuit, is thereby amplified (see FIG. 3). This is the case because the oxidizable gas molecules escaping from food 16 are oxidized by the action of catalyst 22, and the number of gas molecules that displace the oxygen is thereby increased downstream of catalyst 22. In the process, oxygen is consumed. Thus, when using a sensor 14 in the form of an oxygen sensor, the oxygen concentration is reduced to a greater extent than when the sensor is installed upstream of the catalyst in the direction of flow.

When sensors 14 are used which detect gases that are formed during the cooking process and are released by food 16, the output signal of such sensors is also amplified due to the increase in the number of gas molecules. Therefore, first of all, the evaluation of the output signal of sensor 14, and thus the control of the cooking process, is further improved. Secondly, it is possible to use a sensor 14 that is less sensitive and therefore less expensive. The same applies to the use of a humidity sensor.

The above-described arrangement of sensor 14 is not possible if sensor 14 is intended to determine the concentration of at least one oxidizable gas, or of carbon dioxide, as in the present exemplary embodiment. In contrast to this, the arrangement of sensor 14 upstream of catalyst 22 in the direction of flow, as illustrated in FIG. 2, is possible for all gases that are suitable for the method according to the present invention.

The method according to the present invention will now be described in more detail with reference to the Figures.

Food 16 is inserted in cooking chamber 4 and door 2 is closed. When the cooking process is started using one of control knobs 12, i.e., when heating source 20 is switched on, the profile illustrated in FIG. 4 is produced.

Figure 4:
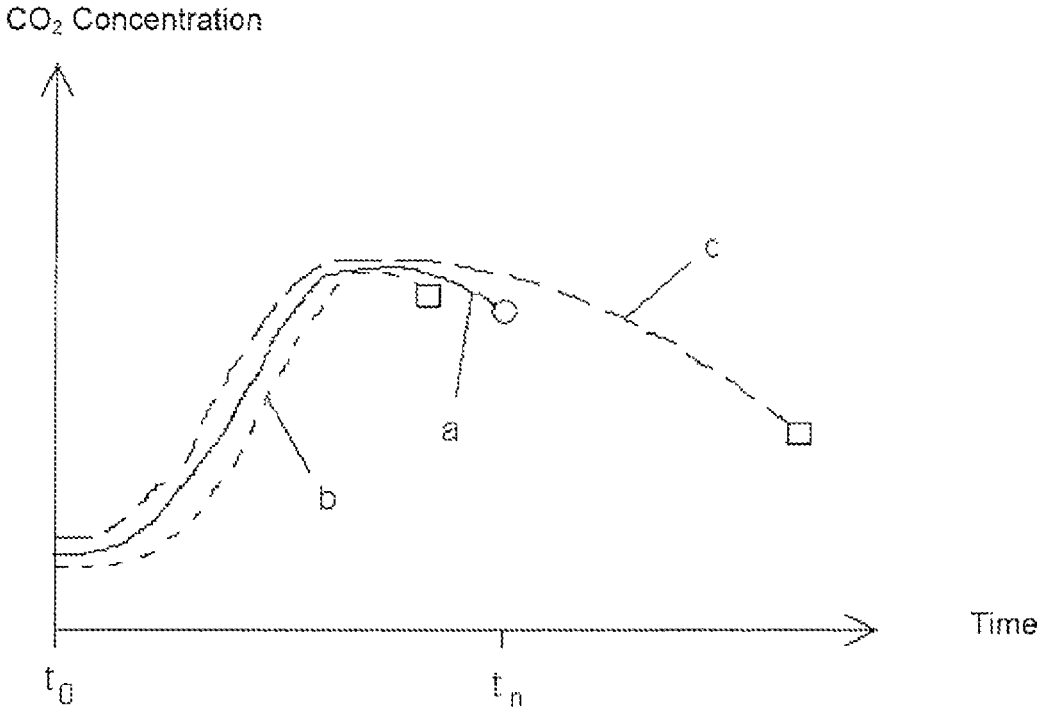
FIG. 4 is a view showing exemplary gas concentration-time profiles at a time $t_n$.

FIG. 4 shows examples of gas concentration-time profiles. The profile of the gas concentration detected by sensor 14 during the current cooking process is illustrated as a solid line a. Dashed lines b and c illustrate, by way of example, two sets of reference values stored in the memory. In reality, the memory has stored therein a multiplicity of sets of reference values, each of which corresponds to the respective shape of a reference function from a starting time $t_0$ to a respective ending time $t_Z$ of a reference cooking process, and with which are associated respective sets of parameters for electrical controller 18. All profiles a, b and c shown in FIG. 4 start at starting time $t_0$. The circle at the other end of line a symbolizes the time $t_n$ of the current cooking process. The square symbols at the other ends of lines b and c symbolize the respective ending times $t_Z$ stored in the memory. As can be clearly seen in FIG. 4, set of reference values b corresponds to a reference function for a short cooking time, while set of reference values c corresponds to a reference function for a long cooking time. At time $t_n$, the ending time $t_Z$ of the reference function represented by b has already passed.

FIG. 4 shows that, after the starting time $t_0$ of the cooking process, the carbon dioxide concentration in cooking chamber 4 increases to a maximum value, after which it decreases until the current time $t_n$ is reached. The variation with time of the carbon dioxide concentration in the current cooking process is detected from the starting time $t_0$ to the time $t_n$ in a manner known to those skilled in the art and stored in the memory. At the time $t_n$, the set of values a generated in the evaluation circuit of electrical controller 18 cannot be directly compared to the stored sets of reference values b and c, because, as explained earlier, the sets of reference values at least partially correspond to reference functions whose ending times $t_Z$ do not coincide with the time of the current comparison $t_n$. Therefore, prior to the comparison, the evaluation circuit generates from the sets of reference values b and c respective sets of comparison values for the comparison at the time $t_n$.

In order to compensate for the differences in the duration of the set of values a with respect to the individual sets of reference values b and c, the values of the sets of reference values of reference functions whose ending time $t_Z$ is smaller than $t_n$, for example, those of the set of reference values b, are complemented from $t_Z$ to the time $t_n$ using an algorithm so as to thereby allow a comparison to the set of values a. The algorithm may consist in that the values of the set of reference values b from the time $t_Z$ to the time $t_n$ are taken to be the same as the values of the set of values a in this time interval. Alternatively, the values of the set of reference values b in this time interval can be taken to be 0. In another alternative, the values of the set of reference values b in this time interval are taken to be the product of a number between 0 and 1 and the maximum value of the set of reference values b in the time interval $t_0$ to $t_Z$. The latter alternative is therefore a compromise between the first and second algorithms. In this manner, the methods generates from the set of reference values b a respective set of comparison values which can then be compared in the evaluation circuit to the set of values a. The like applies to sets of reference values of reference functions whose ending time $t_Z$ is greater than $t_n$, for example, those of the set of reference values c. Here, however, instead of the set of reference values c, the set of values a is complemented from $t_n$ to the time $t_Z$ using an algorithm.

In the case of sets of reference values whose ending time $t_Z$ is identical to the current comparison time $t_n$, the set of reference values does not necessarily have to be transformed into a set of comparison values. However, it may be useful to always perform a transformation, for example, to allow the comparison to be made at an earlier point in time during the current cooking process. This will be explained in more detail further hereinbelow.

In the evaluation circuit, the set of values a is then compared, in a manner known to those skilled in the art, to the multiplicity of sets of comparison values associated with the sets of reference values, for example b and c.

In the present exemplary embodiment, the three sets of comparison values which, at the time $t_n$, come closest to the set of values are then automatically selected by the evaluation circuit. In order to improve the quality of the comparison of the present invention, the similarity of a set of comparison values with the associated ending time $t_Z$ to the set of values is determined according to the difference between the time $t_n$ and the respective ending time $t_Z$. For example, the distance between the ending time $t_Z$ and the current comparison time $t_n$ can itself be used for the comparison. In an alternative, the algorithms already described above for generating the sets of comparison values can be used for his purpose.

Thus, in the example illustrated in FIG. 4, the set of reference values b would be more similar to the set of values a than the set of reference values c. Although during the initial phase of the current cooking process, both sets of reference values b and c are approximately equal in similarity, they are nevertheless very different because of their ending times $t_Z$. If, as described above, the distance between the respective ending times $t_Z$ and the current comparison time $t_n$ were itself used for the comparison, the set of reference values b would ultimately be more similar to the set of values a at the current comparison time $t_n$ than the set of reference values c.

Figure 5:
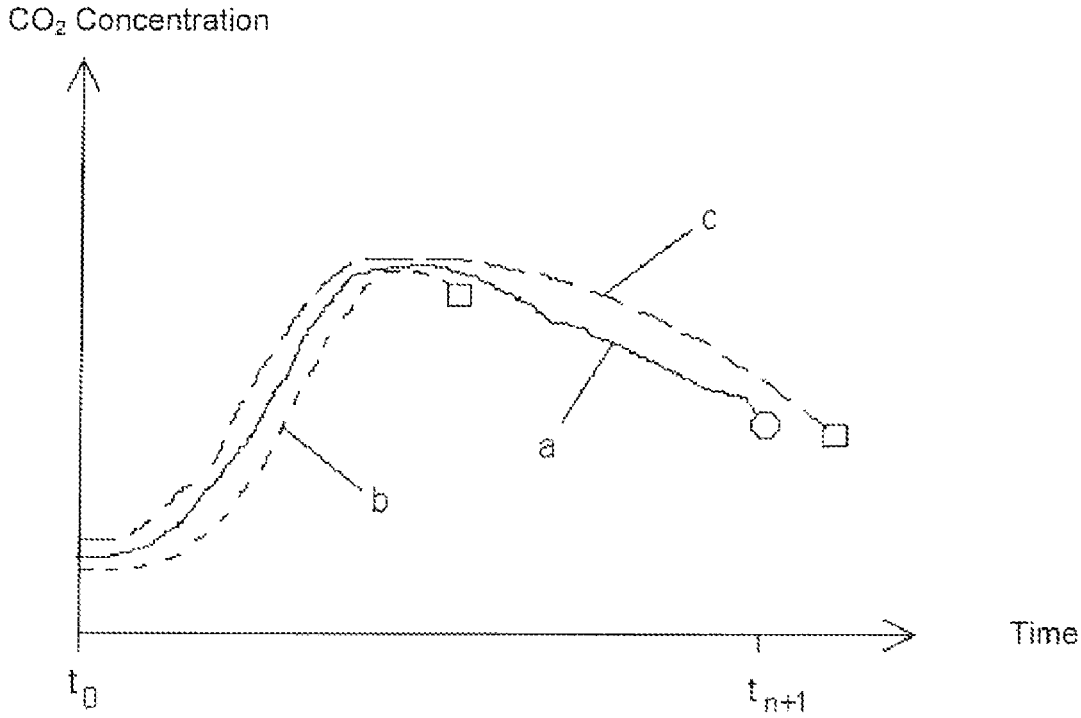
FIG. 5 is a view showing exemplary gas concentration-time profiles at a time $t_{n+1}$.

In the example in FIG. 5, which shows the same sets of reference values b and c, it would be the other way round, provided that the same criteria as in the example of FIG. 4 are used for determining the similarity of the respective sets of reference values b, c to the set of values a. At the later time $t_{n+1}$ shown in FIG. 5, the set of values a has progressed further, so that now the set of reference values c is more similar to the set of values a than the set of reference values b.

In this manner, the three sets of comparison values which come closest to the set of values a are selected. These selected sets of comparison values have associated therewith respective sets of reference values and sets of parameters.

Using a predefined algorithm, one single set of parameters is generated from these three sets of parameters, said single set of parameters being used for electrical controller 18 until the next comparison is made at the time $t_{n+1}$. The set of parameters generated in this manner includes at least the ending time of the current cooking process, which has been determined from the individual ending times $t_Z$ of the three sets of parameters. This can be done, for example, by calculating the arithmetic mean of the ending times $t_Z$ of the selected sets of comparison values or reference values. It is also possible to use other suitable mathematical methods known to those skilled in the art.

As explained earlier, the method of the present invention is continuously repeated during the current cooking process. It is automatically stopped as soon as an ending time of the cooking process that is determined by the evaluation circuit in accordance with the comparisons made has been reached during the current cooking process.

In principle, the stored sets of parameters which are associated with the individual sets of reference values, and thus, the set of parameters used for controlling the current cooking process, can include a multiplicity of suitable parameters. Advantageously, the set of parameters generated as described above is used to cause the remaining cooking time to be displayed on display 10 of the cooking appliance and/or to cause the heating source 20 for heating cooking chamber 4 to be automatically switched off and/or to trigger an audible end-of-cooking signal.

In a preferred embodiment of the method of the present invention, the generated set of parameters is used to determine the type of food 16 in the current cooking process, and to select the mode of operation and the cooking chamber temperature for the cooking process. This requires that the comparison of the present invention be carried out already during initial phase of the current cooking process. Until this point in time, the cooking appliance may be operated with a program that is identical for all foods 16, or for individual groups of foods 16, in order to generate a set of values that is suitable for the comparison.

Alternatively or additionally, the output signal of sensor 14 is processed in the inventive manner in the evaluation circuit only after a only after a predetermined time delay has elapsed after the starting time $t_0$. This ensures that disturbances of the output signal during an initial period after the beginning of the cooking process cannot affect the processing of the output signal in an unwanted manner. The output signal may be disturbed, for example, by fast heating; i.e., heating at maximum heating power, or by switching on a convection fan (not shown). This results in local extreme values, i.e., local minimum and maximum values of the set of values. In this connection, the duration of the delay time can be determined and defined, for example, by tests. In the simplest case, the delay time can itself be stored in the memory. Alternatively, it is possible to determine the duration of the delay time only during the current cooking process. For example, the end of the delay time can be determined according to the variation with time of the gas concentration detected by sensor 14. Suitable for this purpose are changes in the gas concentration profile which are easily detectable by sensor 14, such as extreme values or inflection points.

In this connection, it should be noted that the terms "extreme value" and "maximum and minimum values" are not to be understood in a strictly mathematical sense. In the context of the present invention, these terms are understood to also include a plateau, which means that the gas concentration remains constant at the highest or lowest value for a period of time.

If, instead of a sensor 14 which detects only one gas, a sensor 14 is used which detects a plurality of gases, then, in an alternative to the present exemplary embodiment of the method of the present invention, this plurality of gases can be evaluated in electrical controller 18, and used for the comparison of the present invention. Thus, for this purpose, a multiplicity of multidimensional sets of reference values would be compared to a multidimensional set of values at the comparison time $t_n$ in the manner explained above. In this connection, the number of dimensions in the sets of reference values is identical to the number of dimensions in the set of values and equal to the number of gases detected by sensor 14. Instead of dimensions, one could also speak of "subsets of values".

In tests, it was found that the output signals of such a sensor 14 which are transmitted to the evaluation unit of electrical controller 18 are particularly suited for evaluation, and thus for the comparison of the present invention, if the stored multidimensional sets of reference values and the set of values of the current cooking process were generated according to a predetermined and continuously repeated temperature profile at sensor 14 or in the vicinity thereof. Such a temperature profile is shown by way of example in FIG. 6.

Figure 6:
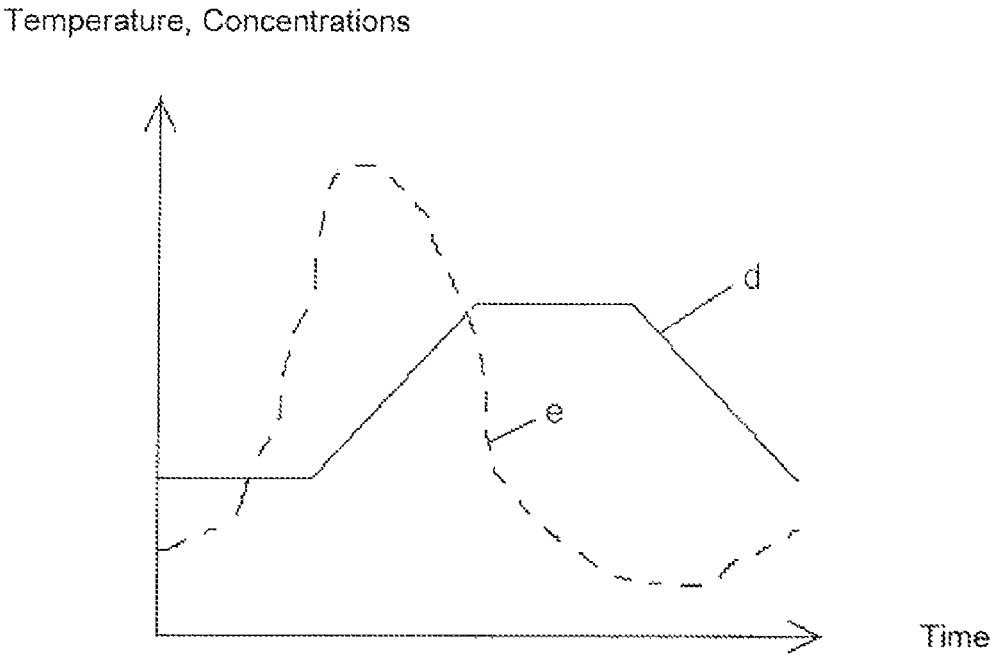
FIG. 6 is a view showing another exemplary gas concentration-time profile and a temperature-time profile.

The temperature cycle illustrated in FIG. 6 is continuously repeated for the entire duration of the current cooking process. The duration of such a temperature cycle can be equal of the time interval between two consecutive comparison times $t_n$ and $t_{n+1}$. In the alternative embodiment described here, the duration of one temperature cycle is much shorter than the time interval between two consecutive comparison times $t_n$ and $t_{n+1}$. For the sake of clarity, only one temperature cycle d is shown in FIG. 6 along with the concentration curve e associated therewith. During temperature cycle d, sensor 14 takes measurements at different points in time. In the present exemplary embodiment, the concentrations of different gases are detected by sensor 14 at least two different points in time. In this manner, an artificial curve shape is obtained, as shown by way of example in FIG. 6. The values of curve e correspond to the concentrations of at least two different gases which were detected by sensor 14 during temperature cycle d. If four different gases were detected by sensor 14, then sensor 14 would alternately measure the concentration of each of the four gases at the times of measurement. Electrical controller 18 would then use the individual values measured in this manner to generate a time profile in a manner known to those skilled in the art. The further processing is as already described above. The number of dimensions, or subsets of values, of the set of values generated in this manner and of the stored sets of reference values would be four in this case.

In case of a very high number of sets of reference values, it may be useful to preselect a subset from the multiplicity of sets of comparison values for the next comparison at the time $t_n$, said preselection being made according to an input via control element 12 of the cooking appliance, or according to a preliminary comparison between the set of values and the multiplicity of sets of comparison values made by the evaluation circuit at a predetermined time $t_1$, with $t_1$ being greater than $t_0$ and smaller than $t_n$. This preselection can be made, for example, by preselecting, from the sum of sets of reference values or comparison values, those whose maximum values, or whose first maximum values, fall within a predetermined time interval around the time of the maximum value, or of the first maximum value, of the set of values.

An alternative, or additional, way of reducing the amount of data to be processed in electrical controller 18 in case of a high number of sets of reference values is to normalize the set of values prior to the comparison and to subsequently compare it to sets of reference values which are also normalized. The set of values and the stored sets of reference values can, in principle, be normalized simply. It is suitable to use a double normalization here, which will be explained in more detail with reference to FIGS. 7 and 8.

Figure 7:
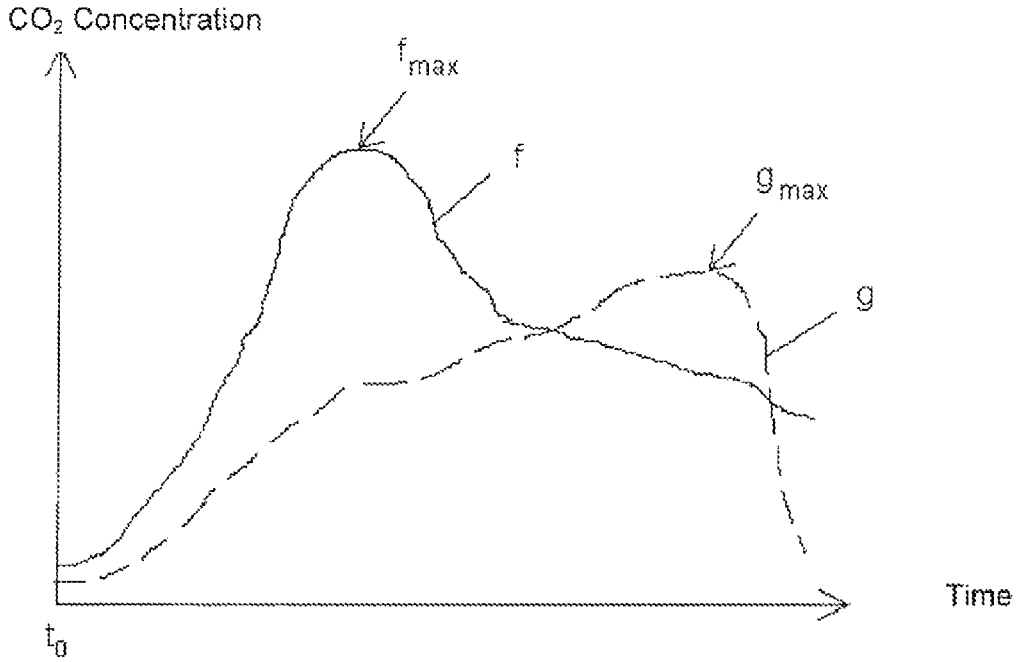
FIG. 7 is a view showing further exemplary gas concentration-time profiles, which are not normalized.

FIG. 7 shows, by way of example, set of values f generated from the carbon dioxide concentration measured during a current cooking process, and a stored set of reference values g. The two profiles are not normalized and have a maximum value $f_{max}$ and a maximum value $g_{max}$, respectively.

Figure 8:
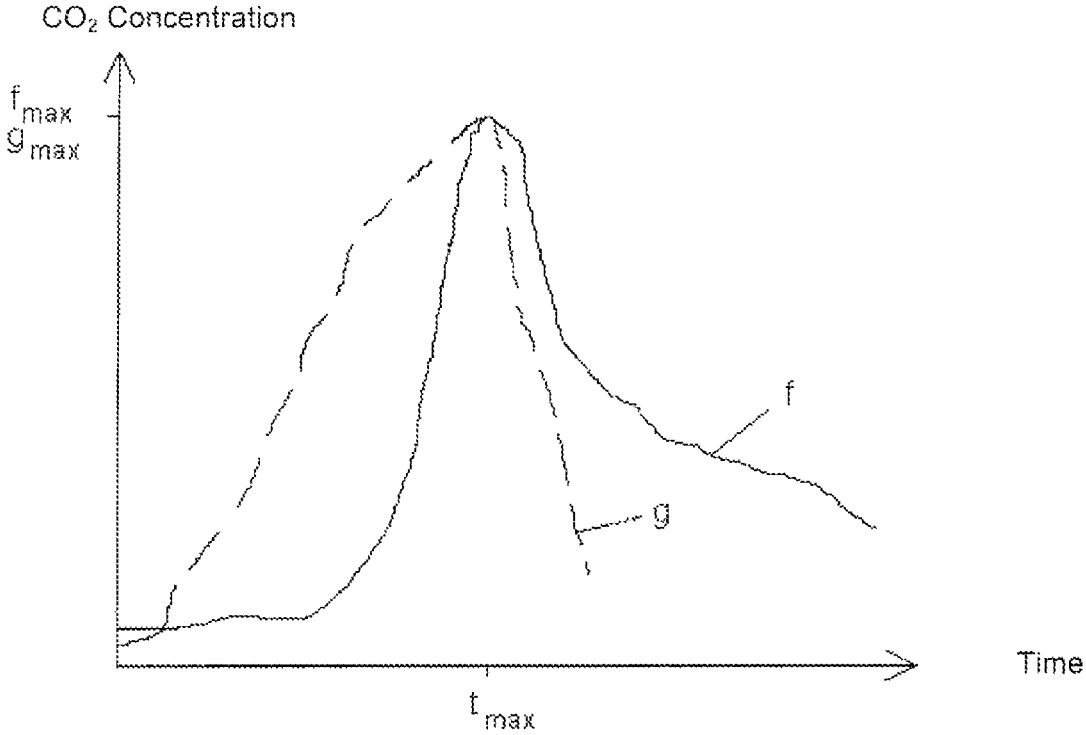
FIG. 8 is a view showing the gas concentration-time profiles of FIG. 7 in a double normalized format.

FIG. 8 shows the set of values f and the set of reference values g of FIG. 7 in a double normalized format. In this example, the maximum value $f_{max}$ of the set of values and the time $t_{max}$ associated with this maximum value were taken to be 1. In the case of profiles having a plurality of local maximum values, it is also possible to normalize to the first maximum value in time, and to the time associated therewith. It is also possible to use other normalizations known to those skilled in the art.

In another advantageous refinement of the aforementioned embodiment, a derivative with respect to time, for example, the first derivative with respect to time, is taken of each of the profiles of FIG. 7 before they are normalized. In this manner, extreme values and inflection points to be used for normalization can be obtained at an even earlier time during the current cooking process. Thus, the evaluation in electrical controller 18 can be started earlier, which allows the cooking appliance to generate information for the user at an early point in time in the manner already explained above.

The teaching of the present invention is not limited to the present exemplary embodiment. For example, the plurality of sets of comparison values with the greatest similarity can be selected within wide suitable limits, and is not limited to three. Further, it is possible to use other suitable algorithms known to those skilled in the art for generating the sets of comparison values, for performing the comparison, and for generating the set of parameters used for controller 18 until the respective next comparison is made. Moreover, the type of sensor 14, and thus the types of gas detectable by said sensor, can be selected within wide suitable limits. For example, it is possible to evaluate the oxygen concentration or the concentration of individual, oxidizable gases. Furthermore, the method of the present invention is not limited to a selection of recipes, modes of operation, or cooking chamber temperatures.

What is claimed is:

1. A method for controlling a cooking process in a cooking appliance, the cooking appliance including a cooking chamber, at least one sensor for detecting a gas concentration in the cooking chamber, and an electrical controller having an evaluation circuit with a timer and a memory and being in signal communication with the sensor, the memory having stored therein a plurality of sets of reference values, each of the sets of reference values corresponding to a respective shape of a reference function from a starting time $t_0$ to a respective ending time $t_Z$ of a reference cooking process, respective sets of parameters for the electrical controller being associated with the sets of reference values, the method comprising the steps in sequence:

a) determining, in the evaluation circuit, from a gas concentration detected during the cooking process, a set of function values corresponding to a shape of a function that depends on the gas concentration from a starting time $t_0$ to a current time $t_n$, during a cooking process;

b) generating, in the evaluation circuit, from the sets of reference values, respective sets of comparison values for a comparison at the time $t_n$;

c) comparing, in the evaluation circuit, the set of function values to the respective sets of comparison values;

d) automatically selecting, using the evaluation circuit, a plurality of the sets of comparison values coming closest to the set of function values, and generating, using an algorithm, from the respective sets of parameters associated with the respective sets of reference values associated with the selected sets of comparison values, a selected set of parameters including at least an ending time of the cooking process, and using the selected set of parameters for the electrical controller until a next comparison is made at a time $t_{n+1}$; and e) repeating steps a)-d) until the ending time of the cooking process has been reached.

2. The method as recited in claim 1 wherein step c) is performed by determining a similarity of a first set of the respective sets of comparison values to the set of function values according to a difference between the time t and a first ending time $t_Z$, the first set of the comparison values having the first ending time $t_Z$.

3. The method as recited in claim 1 wherein the detected gas concentration includes a concentration of carbon dioxide detected by the sensor, the set of function values determined in step a) corresponding to a variation over time of the concentration of carbon dioxide.

4. The method as recited in claim 1 wherein the detected gas concentration includes a concentration of oxygen detected by the sensor, the set of function values determined in step a) corresponding to a first derivative of the concentration of oxygen over time.

5. The method as recited in claim 1 wherein the detected gas concentration includes a concentration of oxidizable gas detected by the sensor.

6. The method as recited in claim 3 wherein the detected gas concentration includes a concentration of at least a second gas, each of the stored sets of reference values including a number of subsets of values equal to the number of gases that have been detected.

7. The method as recited in claim 4 wherein the detected gas concentration includes a concentration of at least a second gas, each of the stored sets of reference values including a number of subsets of values equal to the number of gases that have been detected.

8. The method as recited in claim 5 wherein the detected gas concentration includes a concentration of at least a second gas, each of the stored sets of reference values including a number of subsets of values equal to the number of gases that have been detected.

9. The method as recited in claim 1 further comprising, using the selected set of parameters, at least one of the steps:

f) displaying a remaining cooking time on a display of the cooking appliance;

g) automatically switching off a heating source for heating the cooking chamber; and h) triggering an audible end-of-cooking signal.

10. The method as recited in claim 1 further comprising, using the selected set of parameters, the steps:

i) determining a type of food in the cooking process; and j) at least one of selecting and displaying a mode of operation of the cooking process and a cooking chamber temperature for the cooking process.

11. The method as recited in claim 1 wherein an output signal of the sensor is processed in the evaluation circuit only after a predetermined time delay has elapsed after the starting time $t_0$.

* * * * *